United States Patent [19]

Wendt

[11] Patent Number: 4,616,461

[45] Date of Patent: Oct. 14, 1986

[54] WALL PANEL ATTACHMENT HOOK

[75] Inventor: Alan C. Wendt, Barrington, Ill.

[73] Assignee: United States Gypsum Company, Chicago, Ill.

[21] Appl. No.: 566,912

[22] Filed: Dec. 30, 1983

[51] Int. Cl.[4] ..... E04B 5/52

[52] U.S. Cl. ..... 52/481; 52/714; 292/101

[58] Field of Search ..... 52/479, 481, 764, 712, 52/713, 714, 489; 292/95, 101, 252

[56] References Cited

U.S. PATENT DOCUMENTS

| | | | |
|---|---|---|---|
| 2,244,361 | 6/1941 | Hall | 292/101 |
| 3,563,577 | 2/1971 | Wittenmayer | 52/481 X |
| 4,043,092 | 8/1977 | Paul et al. | 52/712 |
| 4,194,336 | 3/1980 | Weinar | 52/481 |
| 4,263,764 | 4/1981 | Wendt | 52/713 X |
| 4,296,580 | 10/1981 | Weinar | 52/281 |

FOREIGN PATENT DOCUMENTS

| | | | |
|---|---|---|---|
| 1511068 | 5/1978 | United Kingdom | 52/714 |

*Primary Examiner*—William F. Pate, III
*Assistant Examiner*—Creighton Smith
*Attorney, Agent, or Firm*—Robert M. Didrick; Samuel Kurlandsky; Robert H. Robinson

[57] ABSTRACT

A wall panel such as gypsum board or cement board is attached to a stud disposed between the ends of a panel by a wire hook. The hook has an arcuate talon which is pushed into the core of the panel and a shank portion which is fastened to the web of the stud. A portion of the talon lies in a plane which is parallel to the faces of the panel.

3 Claims, 5 Drawing Figures

WALL PANEL ATTACHMENT HOOK

This invention relates to perimeter or partition wall construction wherein wall boards made of gypsum or lightweight concrete are secured to a supporting framework comprised of studs, splines, runners, and the like. In particular it relates to one-piece wire clips which are attached to channel-shaped metal studs or wooden studs by screws or nails and which hook into the field of a wall board.

The use of pre-decorated gypsum panels is a popular method of construction. This is mainly because once the partition is erected, no further finishing is required. However, in order to achieve an aesthetically pleasing appearance, the devices for attachment of the panels to the studs must be concealed. Numerous fasteners have been devised to secure such panels while avoiding the use of unsightly fastening devices. In U.S. Pat. No. 4,194,336 to Weinar, a barbed retainer clip engages a flange of an "H" stud by means of a resilient tab shear-formed from a flat plate of spring steel. "V"-shaped barbs extend from both surfaces of a leg of the clip which is perpendicular to the plate. When a panel is shoved into position against a retainer clip, the flat "V"-shaped barbs pierce the edge of the panel. A disadvantage of such a clip is the tendency for the flat barbs to cleave the gypsum core along the edges of the panel and thus weaken the panel at the points of attachment to the stud. Other disadvantages of such a clip are that it displaces a relatively large portion of the core and it often bends while being driven into the edge of the panel, causing a visible bulge or pooch on the panel face. A similar clip which is attached to a stud by a screw is described in U.S. Pat. No. 4,296,580. Flat steel clips of either kind are relatively expensive to make and time consuming to install.

Because of the semi-rigid nature of insulation sheets such as mineral wool felts and their concealed location, the problem of pooching is not encountered during the attachment of such sheets to structural members. U.S. Pat. No. 4,043,092 does teach a pronged clip, however, for attaching such sheets to structural members having a projecting edge, such as an I-beam. The clip grips a flange of the beam and the elongated prongs of the clip, some of which are perpendicular to the flange and others parallel to the flange, pass through insulation sheets boxing in the beam. The ends of the prongs must be capped or bent in order to hold the insulation in place.

It is an object of this invention to provide an improved wall construction.

It is a related object of this invention to provide a non-pooching wire hook for attaching wallboard panels to studs.

It is another related object of this invention to provide a concealable wallboard fastening hook which impales the field of the wallboard without splitting the core.

Other objects and advantages of this invention will become apparent upon reference to the description and to the drawings.

In accordance with these objects, a paneled wall construction is provided in which "pooching" of the surface of the panels is eliminated. The partition comprises in combination an aligned row of continguous panels, rectangular studs disposed subjacent to the panels at the joints between adjacent panels and at intermediate locations between the joints, and wire hooks which attach the panels to the intermediate studs. A rectangular stud is one whose perimeter defines an open or closed rectangle and is examplified by a channel-shaped metal stud and by a wooden stud. The hook of this invention is a piece of wire or a suitable plastic rod having an eyelet formed at one end and an arcuate talon at the opposite end.

Referring now to the drawings.

Figure 1:
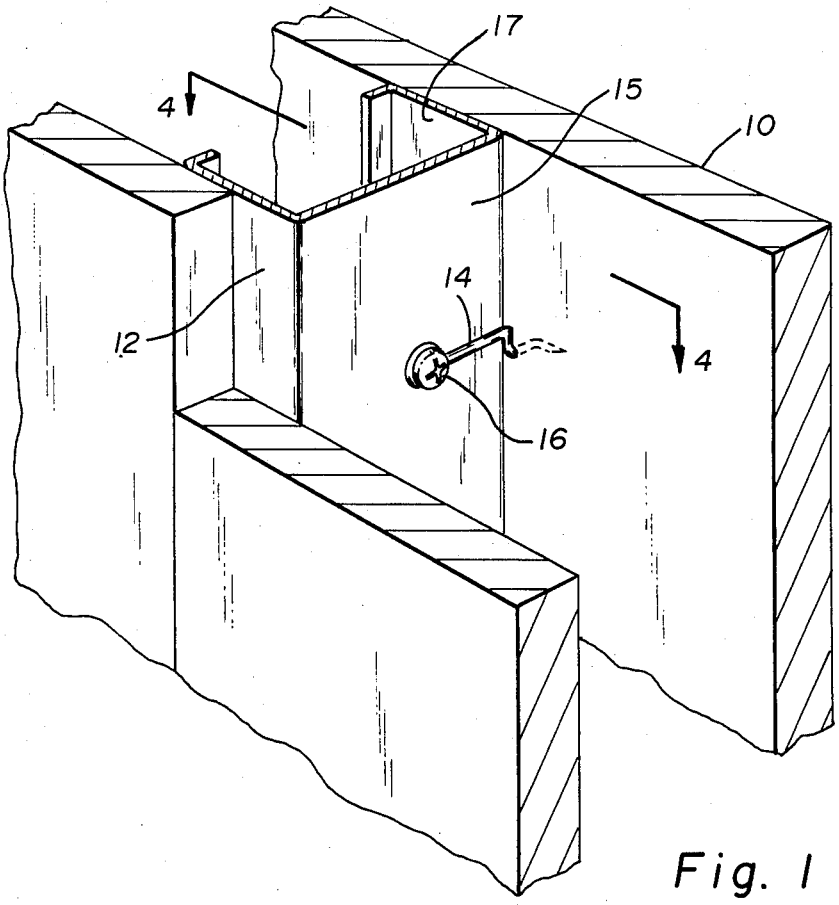
FIG. 1 is a perspective view, partially broken away, of a portion of the wall construction system of this invention.
Figure 4A:
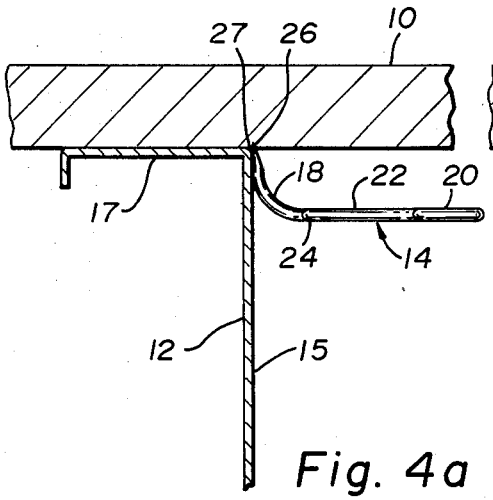

FIG. 4*a* is a view, partially in section along line 4—4 of FIG. 1, showing the position of the hook as it is being inserted in the field of a wall panel.

Figure 4B:
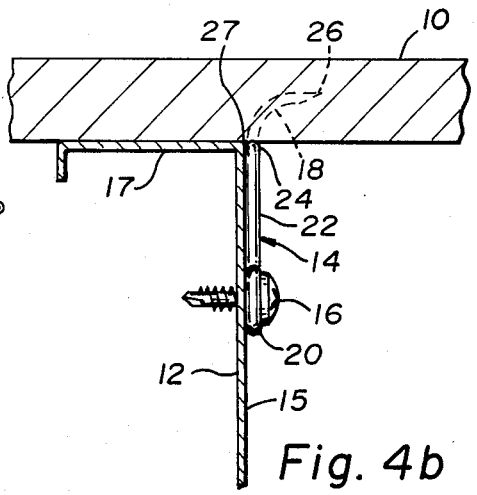

FIG. 4*b* is a sectional view of the wall construction system taken along lines 4—4 of FIG. 1.

In FIG. 1, the panel 10 is attached to the steel stud 12 by the hook 14 which, in turn, is fastened to the web 15 of the stud 12 by the screw 16. In a preferred construction, beads or dabs of an adhesive are applied to the flange 17 of the stud before the panel is placed against it and the hook 14 is inserted in the panel.

Figure 2:
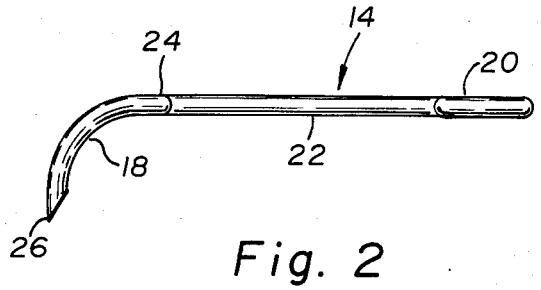
FIG. 2 is an elevational view of the panel attachment hook of this invention.
Figure 3:
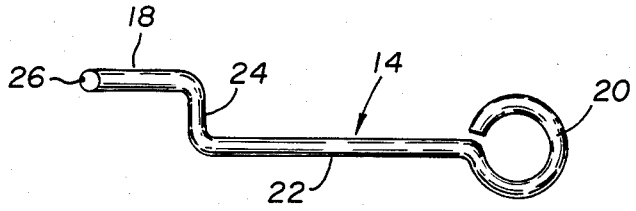
FIG. 3 is a plan view of the hook of this invention.

In FIGS. 2 and 3, the eyelet 20, the shank 22, and the shoulder 24 are co-planar but the shoulder projects at a right angle to the shank. The talon 18, in turn, is disposed at a right angle to the shoulder 24 and curves away from the plane in which the eyelet, shank and shoulder lie. Thus, as shown in FIGS. 4*a* and 4*b*, when the panel 10 is being attached to the stud 12, the hook 14 is brought into a position against the field of the panel so that the eyelet, shank, and shoulder are substantially parallel to the panel and the point 26 of the talon 18 is pushed into the panel at the juncture of the panel and the stud 12. The talon 18 is pushed further into the core of the panel as the eyelet 20 is swung toward the web 15, using the edge 27 of the stud 12 as a fulcrum. The shoulder 24 serves as a stop to limit the travel of the talon 18. When the shoulder rests against the panel, the eyelet lies flat against the web 15 and the self-tapping screw 16 is passed through the eyelet and twisted into the web 15. FIG. 4*b* shows that the distal portion of the talon 18 of the hook 14 is substantially parallel to the faces of the panel 10. The appearance of the visible face of the panel 10 is not marred by the talon.

The size of the hook 14 may vary according to the thickness and weight of the panel but for the attachment of a 0.5 inch thick, vinyl-laminated gypsum panel a hook made from 0.050 inch diameter music wire is satisfactory. The arc defined by the talon 18 of such a hook has a radius of 0.25 inch and the distance from the shoulder 24 to the center of the eyelet 20 is 1 inch (2.54 cm).

Although a particular embodiment of the invention has been described, it will be understood that the invention may be modified within the spirit and scope of the appended claims.

The subject matter claimed is:

1. A wall construction system comprising in combination an aligned row of contiguous panels, a plurality of vertical studs disposed in abutting relationship with the panels at the joints between said contiguous panels and at intermediate locations between the joints, and a wire hook which attaches a panel to an intermediate stud, said hook comprising a shank juxtaposed against an intermediate stud face normal to a panel and fastened to said face and an arcuate talon curving into the core of a panel from the juncture of the stud and the panel.

2. The system of claim 1 wherein the portion of the talon which is distal to the shank is substantially parallel to the faces of the panel.

3. The system of claim 1 wherein the shank has an eyelet formed at the end opposite the talon and a shoulder, co-planar with the shank and eyelet but at a right angle to said shank, is interposed between the shank and the talon.

* * * * *